United States Patent [19]

Salomon

[11] 4,143,886

[45] Mar. 13, 1979

[54] SAFETY SKI BINDING

[75] Inventor: Georges P. J. Salomon, Annecy (Haute-Savoie), France

[73] Assignee: Etablissements Francois Salomon et Fils, Annecy (Haute-Savoie), France

[21] Appl. No.: 725,871

[22] Filed: Sep. 23, 1976

[30] Foreign Application Priority Data

Sep. 30, 1975 [FR] France ..... 75 29924

[51] Int. Cl.[2] ..... A63C 9/08

[52] U.S. Cl. ..... 280/624

[58] Field of Search ..... 280/615, 614, 635, 624, 280/625, 611

[56] References Cited

U.S. PATENT DOCUMENTS

| | | | |
|---|---|---|---|
| 2,173,846 | 9/1939 | Kelley | 280/625 |
| 3,606,370 | 9/1971 | Spademan | 280/624 |
| 3,744,810 | 7/1973 | Jungkind | 280/625 |
| 4,042,257 | 8/1977 | Salomon | 280/624 |

FOREIGN PATENT DOCUMENTS

| | | | |
|---|---|---|---|
| 333584 | 1/1936 | Italy | 280/615 |

*Primary Examiner*—Joseph F. Peters, Jr.
*Assistant Examiner*—Milton L. Smith
*Attorney, Agent, or Firm*—Pollock, Vande Sande & Priddy

[57] ABSTRACT

A ski binding comprises two lateral jaws hinged to a slide arranged upon the longitudinal axis of the ski and subjected to the action of a release spring; a second set of links hinged to a fixed baseplate is also hinged to the jaws. This type of binding locks the boot by its side edges.

8 Claims, 6 Drawing Figures

SAFETY SKI BINDING

The present invention relates to safety bindings designed to secure a ski to a boot and, more particularly, to bindings of the double-jaw type arranged symmetrically in relation to the longitudinal axis of the ski and cooperating with the side edges of the boot.

Bindings of this kind, designed to secure the boot by its edges to the ski, are well known and are disclosed, for example, in Spademan French Pat. No. 2,021,237. The binding described in this patent consists of two arms hinged on each side of the longitudinal axis of the ski, and of jaws engaging with the boot under the action of a resilient element. Both lateral and vertical safety releases take place against this action. The jaws are urged to secure the boot by means of a slide acting upon the arms of the jaws by means of a system of ramps, cams, etc. A design of this kind has the disadvantages inherent in any system consisting of arms, slides, ramps and cams, since the friction between these parts interferes with the satisfactory functioning and resilience of the system.

It is an object of this invention to improve this type of binding by effecting a considerable reduction in parasitic friction, and thus increase the reliability of the device.

To this end, the safety binding according to the invention comprises:

(a) a baseplate mounted upon the ski;

(b) two jaws which move in relation to the baseplate, arranged symmetrically in relation to the longitudinal axis of the ski, and cooperating with each side edge of the boot, or with a part temporarily fitted under the boot; and (c) a slide subjected to the action of a resilient element and adapted to slide upon the baseplate, the slide and its resilient element cooperating directly or indirectly with the jaws in order to keep them bearing against the boot.

The invention is to be perceived in that the binding defined above comprises two pairs of links arranged symmetrically in relation to the longitudinal axis of the ski, each comprising a link hinged to the baseplate, and a link hinged to the slide, the links being furthermore hinged to one another, and one of them being integral with the jaw.

As a result of this arrangement, the movement of the slide is transmitted to the jaws, causing them to open, in the plane of the ski, but without creating any friction between parts sliding in relation to each other since, thanks to the links, all of the parts, with the exception of the slide, carry out pivoting movements only.

According to one preferred embodiment of the invention, the jaw is integral with the link hinged to the slide, the other link being hinged to the baseplate. The link mounted upon the baseplate is preferably hinged to the link integral with the jaw at a point located between the jaw and the hinge upon the slide with the hinge on the base plate being located at a position longitudinally of of the ski between the hinge point on the jaw and the hinge point on the slide.

This design is preferred since it makes it possible to obtain a jaw-release curve well suited to an adequate functioning of this type of binding, the opening angle of the jaws being larger than that obtainable with conventional bindings, due to the fact that the jaws are hinged to a moving slide.

In a second embodiment, the jaw is integral with the link hinged to the baseplate, and the link hinged to the slide is preferably hinged also to the link integral with the jaw in an area located between the jaw and the hinge to the baseplate with the hinge on the base plate again being located at a position longitudinally of the ski between the hinge on the jaw and the hinge on the slide.

It is also preferable, and this applies to both of the foregoing embodiments, that the hinge point of the link mounted upon the baseplate be displaced laterally outwards in relation to the hinge point of the link mounted upon the slide.

This relative arrangement of the hinge points of the links provides a more compact binding design, with a mechanism whose performance is optimal.

In order to allow the skier to remove the ski whenever he so desires, for instance after a run, the binding is equipped with a voluntary ski-removal system consisting of a lever linked to the slide and displacing the slide against the action of the resilient element, thus causing the jaws to open.

The ski-removal lever is hinged to a shaft on the slide and has a ramp cooperating with a support area which is stationary in relation to the ski.

Furthermore, the hinge axis of the lever on the slide is guided in a slot in the baseplate running parallel with the ski, so that the rocking motion of the unlocking lever may be converted into a sliding motion of the slide.

It should be noted that the lever is returned to its upward position automatically when the resilient element restores the slide to its normal position. As a variant, a neutral ramp extending the stationary support zone may immobilize the lever in the downward position, thus keeping the binding in the open position.

A description will now be given, in no way restrictive, of embodiments of the invention illustrated in the drawing attached hereto, wherein.

Figure 1:
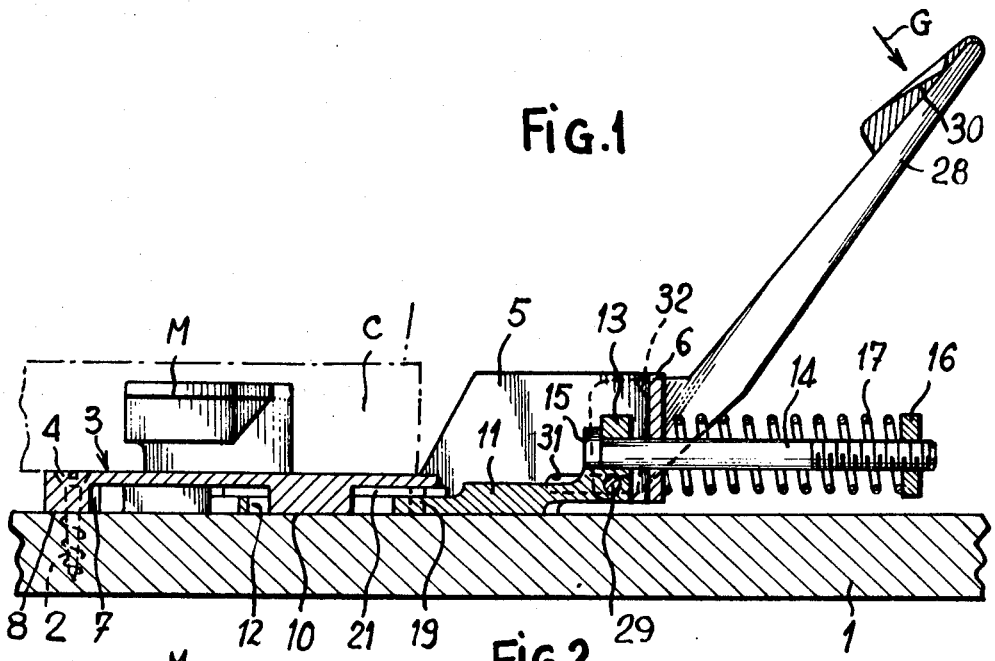
FIG. 1 is a longitudinal section, along line I—I in FIG. 2, of a first embodiment of the invention.

FIG. 1 shows a ski 1 to which is secured, by screws 2, a baseplate 3 extending along the longitudinal axis of the ski.

This baseplate consists of a plate 4 designed to support the heel of a boot C, the plate extending rearwardly in the form of two vertical flanges 5 joined together by a transverse member 6. The bottom of plate 4 is recessed in order to form, with ski 1, a housing 7 accommodating the moving parts of the binding to be described hereinafter.

Figure 3:
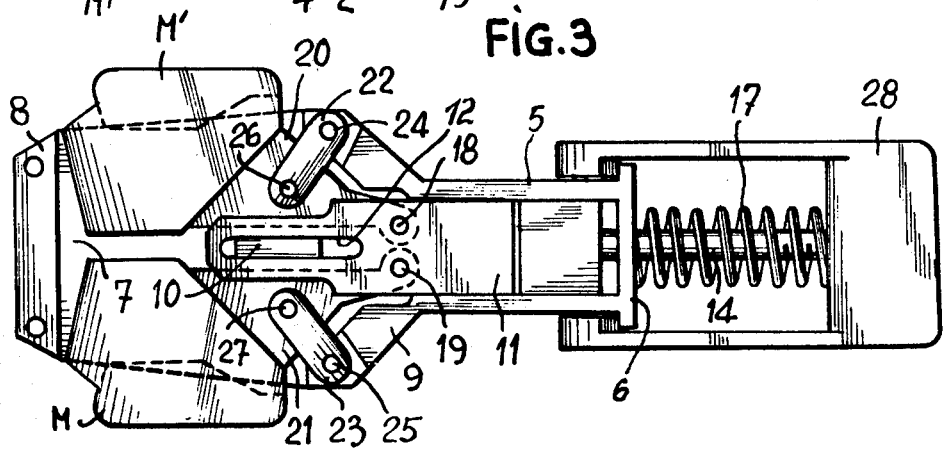
FIG. 3 is a bottom plan view of the binding according to FIGS. 1 and 2, the jaws being shown in the "closed" position.

As shown in FIG. 3, the baseplate rests upon the ski:

(a) at the front end, by means of a supporting surface 8;

(b) laterally, by means of two symmetrical surfaces 9;

(c) centrally, by means of a projection 10 arranged upon the longitudinal axis of the ski.

Mounted between flanges 5 of the baseplate is a slide 11 adapted to slide in the direction of the longitudinal axis of the ski. The nose of the slide has an elongated slot 12 engaging with projection 10 upon the baseplate which thus serves to guide the slide in its longitudinal movement in relation to the ski.

At its rear end, the slide has a vertical wall 13 having a central hole accommodating a rod 14 which also passes through transverse member 6 of the baseplate. The end of the rod adjacent wall 13 has a head with a flat on one side which bears against the slide in order to prevent the rod from rotating. The other end of the rod, which is threaded, has a nut 16 which may be screwed or unscrewed.

Rod 14 is surrounded by a spring 17, one end of which bears against transverse member 6, whereas the other end bears against nut 16. It will be understood that nut 16 may be used to adjust the force of spring 16.

Mounted to pivot upon the central part of slide 11 about axes 18, 19, which are arranged symmetrically in relation to the longitudinal axis of the ski, are links 20, 21, each of which carries, at the end remote from its hinge point, a jaw M, M'.

Since these jaws are not a part of the present invention, the design thereof will not be described here in detail. They may, however, with advantage, be of the type described in Salomon U.S. Pat. No. 4,042,257 issued Aug. 16, 1977.

Two other links 22, 23 are hinged respectively at 24, 25 to the sides of the baseplate.

These links 22, 23 are arranged symmetrically in relation to the longitudinal axis of the ski and are hinged respectively at 26, 27 to links 20, 21. The hinge points 24, 25 are located at a position longitudinally of the ski between the hinge points 26, 27 of the links to the jaws and the hinge points 18, 19 of the jaws to the slide. Finally, the binding is equipped with a voluntary ski-removal lever 28 in the form of a stirrup with arms hinged upon a horizontal axis 29 integral with the slide. The upper transverse portion of lever 28 has an indentation 30 to accommodate, for example, the end of a ski-pole, to facilitate actuation of the lever. Shaft 29, which connects the lever to the slide, passes through flanges 5 on the baseplate which have horizontal slots 31 for the purpose. Finally, the lever carries, in the vicinity of its hinge point to the slide, a ramp 32 for each of the arms, the ramps cooperating with vertical surfaces 33 which are lateral extensions of transverse member 6 of the baseplate.

A description will now be given of the operation of this binding, with reference to FIGS. 1 to 5.

Figure 2:
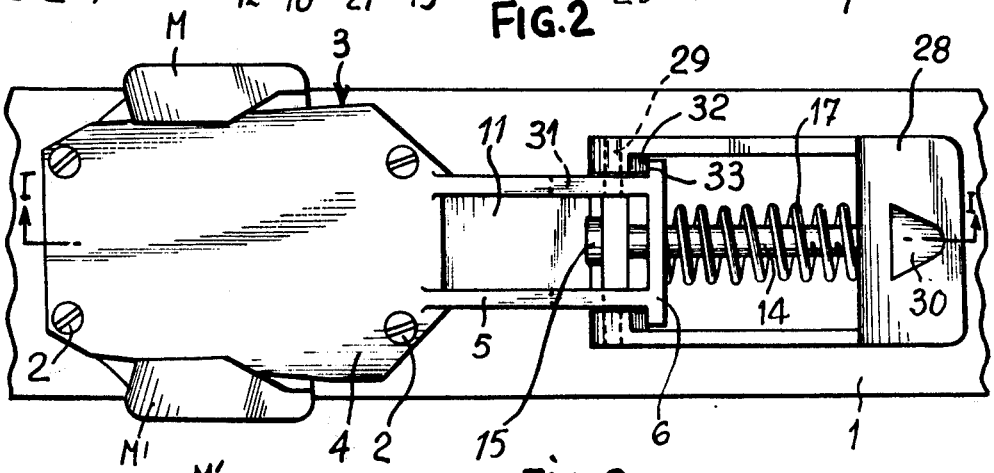
FIG. 2 is a plan view of the binding according to FIG. 1.

The normal position of the binding is that shown in FIGS. 1, 2 and 3, at which time spring 17 holds slide 11 in its terminal position, thus urging the jaws into the closed position holding the boot to the ski.

Figure 4:
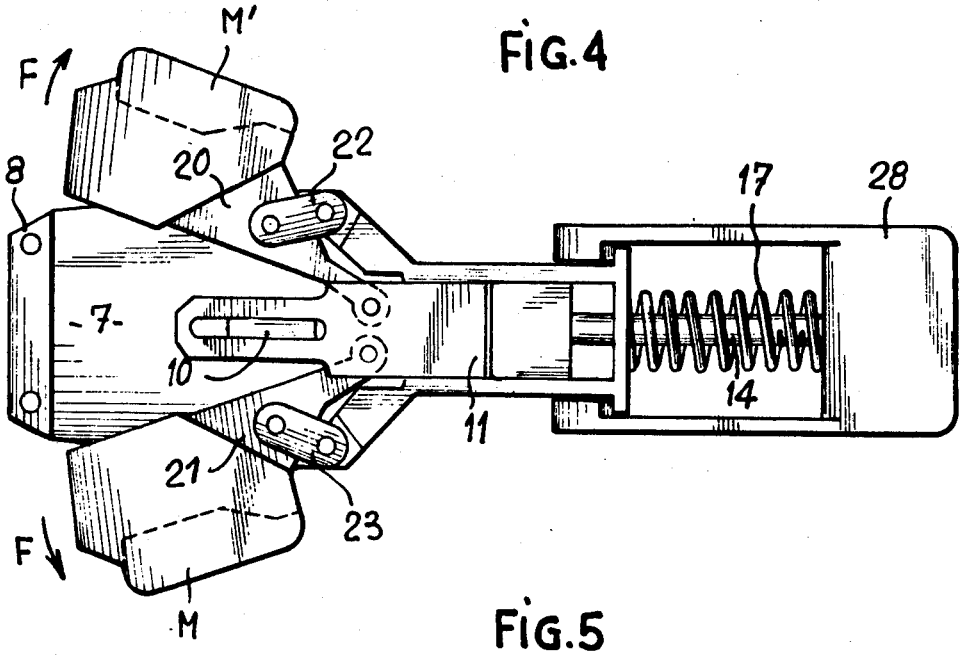
FIG. 4 is a bottom plan view similar to that in FIG. 3, but showing the jaws in the "open" position.
Figure 5:
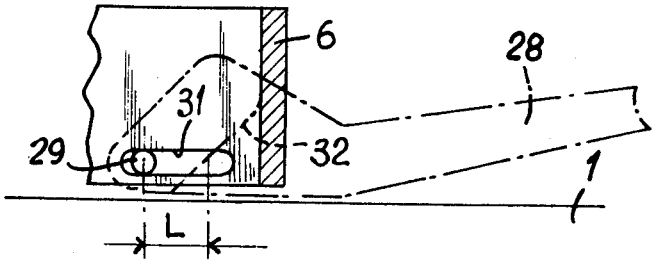
FIG. 5 is a detail showing the ski-removal lever in the position in which it releases the boot.

As soon as a load is applied to the jaws, these tend to open in the direction of arrow F in FIG. 4. This movement of the jaws not only causes links 22, 23 to pivot about their axes 24, 25, but also causes slide 11 to move against the action of spring 17.

If the load applied to the jaws is sufficient to open them fully, the boot will be released and the binding will then close again under the restoring action of spring 17. If it is desired to open the binding voluntarily while boot C is secured to the ski, the skier merely has to apply pressure to unlocking lever 28 in the direction of arrow G in FIG. 1.

This forces lever 28 downwards and, as a result of the cooperation between ramps 32 and supporting surfaces 33, slide 11 moves forward by a distance L (see FIG. 5) corresponding to the boot-release travel. This forward movement of the slide also causes the jaws to open by pivoting links 22, 23 and 20, 21, which represents an advantage as compared with known bindings.

Figure 6:
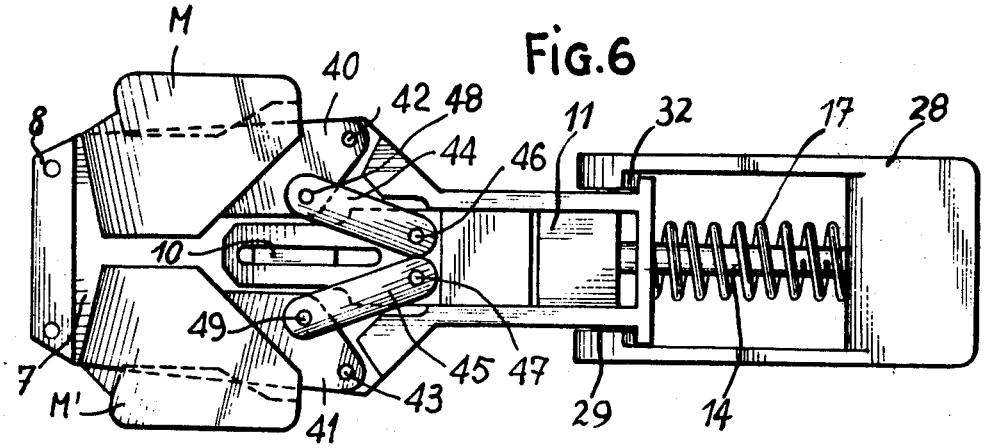
FIG. 6 is a bottom plan view of a second example of embodiment of the invention.

A description will now be given of the second embodiment of the invention, as illustrated in FIG. 6. In this figure, the components are identical with those in the example illustrated in FIGS. 1 to 5. The only difference is that jaws M, M' are integral with links 40, 41 which are hinged at 42, 43 on axes carried by a baseplate, one end of each of links 44, 45 being hinged to the slide at 46, 47, while the other ends are hinged at 48, 49 to links 40, 41 integral with the jaws. The relative locations of the hinge points longitudinally of the ski are the same as in the first embodiment.

The operation of this second embodiment is identical with that already described.

Finally, it is to be noted that, in all of the illustrated embodiments, the stationary hinge axes for the links on the baseplate are separate and are arranged symmetrically in relation to the longitudinal axis of the binding, but it is obvious that these axes could well be merged, within the framework of the invention, and arranged along the longitudinal axis of the ski. Moreover, the action of the jaws may be applied to the boot itself or to a part fitted temporarily or permanently to the said boot.

As a variant, the mechanism of the binding could be arranged in the boot and could exert its action upon the ski itself, or upon a part secured thereto.

What I claim is:

1. A safety binding for a ski boot, comprising (a) a baseplate mounted upon the ski;

(b) two lateral jaws movable relative to said baseplate and arranged symmetrically relative to the longitudinal axis of said ski, said jaws cooperating with the lateral sides of said boot;

(c) a slide means subjected to the action of a resilient element and adapted to slide upon said baseplate in the direction of the longitudinal axis of said ski, said slide means and its associated resilient element biasing said jaws toward position in which said jaws are kept bearing against said boot; and (d) two pairs of links arranged symmetrically in relation to the longitudinal axis of said ski, each pair comprising a link hinged to a fixed point of the baseplate, and a link hinged to said slide means, said links being furthermore hinged to one another, and one of said links being integral with one of said jaws, each of said fixed points being located at a position longitudinally of the ski between the hinge point on the corresponding jaw and the corresponding hinge point on said slide means.

2. A binding according to claim 1, including a voluntary ski-removal lever linked to said slide means, actuation of said lever causing movement of said slide means against the action of said resilient element and consequent opening of said jaws.

3. A binding according to claim 2, wherein said ski-removal lever is hinged on an axis upon said slide means and comprises a ramp cooperating with a supporting area which is stationary in relation to said ski, in order to cause said slide means to be displaced in translation.

4. A binding according to claim 3, wherein said hinge axis of said lever upon said slide means is housed and guided in a slot in said baseplate extending parallel to the ski.

5. A safety binding for a ski boot, comprising (a) a baseplate mounted upon the ski;

(b) two lateral jaws movable relative to said baseplate and arranged symmetrically relative to the longitudinal axis of said ski, said jaws cooperating with the lateral sides of said boot;

(c) a slide means subjected to the action of a resilient element and adapted to slide upon said baseplate in the direction of the longitudinal axis of said ski, said slide means and its associated resilient element biasing said jaws toward a position in which said jaws are kept bearing against said boot;

(d) a first pair of links arranged symmetrically relative to said longitudinal axis of said ski and hinged respectively to said slide means, each of said links being integral with one of said lateral jaws; and (e) a second pair of links arranged symmetrically relative to said longitudinal axis of said ski and hinged respectively to a fixed point of said baseplate and to one of said links of said first pair of links, each of said fixed points being located at a position longitudinally of the ski between the hinge point of each of the first pair of links to the corresponding link of the second pair of links on the corresponding jaw and the corresponding hinge point on said slide means.

6. A safety binding as claimed in claim 5, wherein each of said fixed points at which said links of said second pair of links are hinged upon the baseplate is laterally spaced from the hinge point upon the slide means of the corresponding link of said first pair of links.

7. A safety binding for a ski boot, said binding comprising (a) a baseplate mounted upon the ski, (b) two lateral jaws movable relative to said baseplate and arranged symmetrically relative to the longitudinal axis of said ski, said jaws cooperating with the lateral sides of said boot;

(c) a slide means subjected to the action of a resilient element and adapted to slide upon said baseplate in the direction of the longitudinal axis of said ski, said slide means and its associated resilient element biasing said jaws toward a position in which said jaws are kept bearing against said boot;

(d) a first pair of links arranged symmetrically relative to said longitudinal axis of said ski and hinged respectively to a fixed point of said baseplate, each of said links being integral with one of said lateral jaws; and (e) a second pair of links arranged symmetrically relative to said longitudinal axis of said ski and hinged respectively to said slide means and to one link of said first pair of links, each of said fixed points being located at a position longitudinally of the ski between the hinge point of each of the first pair of links to the corresponding link of the second pair of links on the corresponding jaw and the corresponding hinge point on said slide means.

8. A safety binding as claimed in claim 7, wherein each of said fixed points at which said links of said first pair of links are hinged upon the baseplate is laterally spaced from said hinge point upon said slide means of the corresponding link of said second pair of links.

* * * * *